US008926456B2

(12) United States Patent
Mcardle et al.

(10) Patent No.: US 8,926,456 B2
(45) Date of Patent: Jan. 6, 2015

(54) CRICKET OR CRICKET DERIVED GAMES AND EQUIPMENT THEREFOR

(76) Inventors: John Trevor Mcardle, Hants (GB); Roland Lawrence Prittipaul, Hants (GB)

( * ) Notice: Subject to any disclaimer, the term of this patent is extended or adjusted under 35 U.S.C. 154(b) by 470 days.

(21) Appl. No.: 12/996,551

(22) PCT Filed: Jun. 8, 2009

(86) PCT No.: PCT/GB2009/001423

§ 371 (c)(1),
(2), (4) Date: Mar. 14, 2011

(87) PCT Pub. No.: WO2009/147412

PCT Pub. Date: Dec. 10, 2009

(65) Prior Publication Data

US 2011/0160006 A1 Jun. 30, 2011

(30) Foreign Application Priority Data

Jun. 6, 2008 (GB) ..... 0810369.9

(51) Int. Cl.

| | |
|---|---|
| ***A63B 63/00*** | (2006.01) |
| ***A63B 37/00*** | (2006.01) |
| *A63B 59/00* | (2006.01) |
| *A63B 24/00* | (2006.01) |
| *A63B 37/06* | (2006.01) |
| *A63B 71/02* | (2006.01) |
| *A63B 59/08* | (2006.01) |
| *A63B 43/00* | (2006.01) |
| *A63B 71/06* | (2006.01) |

(52) U.S. Cl.

CPC ..... *A63B 24/0021* (2013.01); *A63B 2059/0007* (2013.01); *A63B 2024/0037* (2013.01); *A63B 2037/065* (2013.01); *A63B 2207/00* (2013.01); *A63B 2209/02* (2013.01); *A63B 2024/004* (2013.01); *A63B 71/023* (2013.01); *A63B 37/00* (2013.01); *A63B 2208/12* (2013.01); *A63B 59/08* (2013.01); *A63B 2043/001* (2013.01); *A63B 2243/0016* (2013.01); *A63B 2071/0625* (2013.01); *A63B 71/0669* (2013.01); *A63B 71/0622* (2013.01); *A63B 63/00* (2013.01)

USPC ..... 473/498

(58) Field of Classification Search

USPC ..... 473/498

See application file for complete search history.

(56) References Cited

U.S. PATENT DOCUMENTS

| | | | | |
|---|---|---|---|---|
| 6,286,832 | B1 * | 9/2001 | Willers | 273/236 |
| 6,299,554 | B1 * | 10/2001 | Sinclair et al. | 473/435 |

(Continued)

FOREIGN PATENT DOCUMENTS

| | | | |
|---|---|---|---|
| DE | 10129799 | A1 | 1/2003 |
| GB | 1507433 | | 4/1978 |
| WO | 02089925 | A1 | 11/2002 |

*Primary Examiner* — Kurt Fernstrom
*Assistant Examiner* — Dolores Collins
(74) *Attorney, Agent, or Firm* — Barlow, Josephs & Holmes, Ltd.

(57) ABSTRACT

The invention provides a ball having a resilient higher density plastic outer cover layer over a lower density plastic core and a bat including a handle and a head, the head having a hitting surface and a back surface, the hitting surface having an elongate and substantially planar hitting surface and the back surface being similarly elongate and having a raised spine running along its elongate axis. The invention is characterised in that the bat is formed from plastic or composite material and has a central cavity, and a target article (set of stumps) includes a weighted base and a panel, the panel being formed from a flexible resilient material and the base including a slot into which the panel may be inserted and thereby retained in an upright position. The panel and slot are adapted such that when struck by an object the panel is free to vibrate.

5 Claims, 6 Drawing Sheets

(56) References Cited

U.S. PATENT DOCUMENTS 7,628,716 B2 * 12/2009 Mockry et al. ..... 473/468
7,713,150 B2 * 5/2010 Hart ..... 473/468
8,292,709 B2 * 10/2012 Welch ..... 463/7
8,292,725 B2 * 10/2012 Wikander ..... 463/20
8,348,276 B2 * 1/2013 Brennan ..... 273/118 R
8,360,435 B2 * 1/2013 Dayal et al. ..... 273/317.7
8,388,472 B2 * 3/2013 Blais et al. ..... 473/476

* cited by examiner

CRICKET OR CRICKET DERIVED GAMES AND EQUIPMENT THEREFOR

The present invention relates to the sport of cricket and in particular to adaptations of the sport of cricket and its equipment for play in an urban environment.

Cricket is a very popular sport in many parts of the world, particularly in the Indian Subcontinent, Australasia, Southern Africa, the Caribbean and the United Kingdom. The major problems with increasing participation in the sport, particularly amongst young enthusiast with limited means are the cost of equipment and the limited areas for playing. As such, many enthusiasts resort to indulging in cricket derived games using second hand equipment or whatever substitutes for standard equipment are available. This can create difficulties in that players develop techniques unsuited to conventional cricket due to the unusual nature of the environment or equipment used. Also there is the problem that the equipment used may be unsuitable for the environment in which it is used, a particular example being a small open space in an urban area such as an alleyway, side road, car park or similar. Even if the game is played in say schools, the school may lack the space and/or the time to properly stage cricket.

To provide more specific examples a conventional cricket ball is unsuitable for use in an urban environment as it will rapidly become damaged and misshaped due to the had and abrasive nature of the surfaces. Furthermore, the weight of a cricket ball enables it to do some damage to passers by or property if well struck. Whilst other balls, such as tennis balls may be substituted, these may have very different properties to cricket balls and thus lead to an unsatisfactory and unrealistic experience.

With regard to bats, conventional wooden bats are easily damaged in an urban environment. They are also relatively heavy for use by a child and may be awkward to transport, particularly by bicycle.

With regard to stumps, it may not be possible to insert conventional stumps into the ground but substitutes may be used such as an outline drawn on a substantially vertical surface or a set of sprung practice stumps. Use of an outline raises the potential for argument and sprung practice stumps are relatively heavy and expensive.

Further difficulties are found in implementing a game in a limited space and/or with a limited number of players both in scoring and in ensuring each player is able to take a sufficient part in proceedings. These difficulties are also compounded by the amount of time required to play a conventional game of cricket and the complexity of the rules of conventional cricket.

It is therefore an object of the present invention to address the above problems.

According to a first aspect of the present invention there is provided a ball suitable for use in cricket or a cricket derived game comprising: a resilient higher density plastic outer cover layer provided over a lower density plastic core.

Such a ball is suitable for use on hard and/or abrasive surfaces without incurring damage having a significant effect on its playing properties. The cover layer is relatively resistant to abrasion whilst the core provides structural support and by virtue of being lower density reduces the weight of the ball thus reducing the likelihood of damage occurring to property as a result of impact from the ball.

The ball is preferably resiliently deformable. This reduces the potential distance a ball can be struck with the bat, facilitating smaller play areas. This also reduces the potential for injuries or damage to property caused as a result of impact from the ball.

The core may be formed from polyurethane. In particular the core may be formed from solid polyurethane or from polyurethane foam. The cover may be formed from polyvinyl chloride (PVC).

The ball may have an outer diameter of the order of 65 mm to 70 mm. The cover may have a thickness of the order of 5 mm.

The cover may be provided with a raised band around its equator. The band may thus provide an equivalent of the raised seam on a conventional cricket ball. The band may be adapted to resemble the seam of a conventional cricket ball or may have an alternative decorative appearance. The band may be formed integrally with the cover. Alternatively, the band may be formed separately and attached to the cover by means of a suitable bonding technique.

The raised height of the band may be of the order of 0.05 mm. The width of the band may be of the order of 20 mm.

In some embodiments the band may comprise two or more raised bands running substantially parallel to each other. In an embodiment having a pair of said bands, the separation of said bands may be of the order of 5 mm.

As a further alternative, the cover may be provided with a stitched or printed band. The stitching or printing may be decorative in nature.

The cover may be formed by a suitable one piece moulding technique or may be formed by bonding two separate cover portions together. In suitable embodiments, the join between cover portions may lie along the raised band or between the pair of raised bands. This can reduce the visibility of the join and/or reduce the apparent effect of poorly aligned joins on the balls playing characteristics. The core may be formed separately to the cover and have the cover formed thereover. Alternatively, the core may be formed by injecting material into the cover.

The cover may be coloured. This may be monochrome or may be incorporate patterns or designs in two or more colours. The colours may be dyes incorporated into the material or may be suitable coatings applied thereto. The colours may include high visibility colours. This can enable use in poor light. In some embodiments, the cover may be adapted to incorporate or be coated with a substance that fluoresces under exposure to ultra violet light. The band may be coloured in contrast to the cover. This enables the position of the band to be readily seen by a batter.

The ball surface may be embossed with patterns or designs. The embossed patterns or designs may match the coloured patterns or designs.

The ball may incorporate or be coated by a substance operable to change colour or fluoresce in response to impacts. This can enable an impact to be determined visually.

According to a second aspect of the present invention there is provided a bat suitable for use in cricket or a cricket derived game comprising: a handle and a head, the head having a hitting surface and a back surface, the hitting surface having an elongate and substantially planar hitting surface and the back surface being similarly elongate and having a raised spine running along its elongate axis, characterised in that the bat is formed from plastic or composite material and has a central cavity.

Such a bat is relatively light whilst retaining sufficient strength for its intended use. Furthermore, such a bat would be less affected by abrasion than traditional bats.

The central cavity may be substantially empty or may be filled with low density material.

Suitable materials for forming the bat include PVC, resin, fibreglass, carbon fibre or Kevlar. The bat may be formed by means of a blow moulding process. The thickness of the material forming the bat is typically in the range 3 mm-4 mm.

The bat material is preferably resiliently deformable. This reduces the potential distance a ball can be struck with the bat, facilitating smaller play areas. This also reduces the potential for injuries or damage to property caused directly by bat impacts and indirectly by balls struck by the bat.

The bat surface may be coloured. This may be monochrome or may be incorporate patterns or designs in two or more colours. The colours may be dyes incorporated into the material or may be suitable coatings applied thereto. The bat surface may be embossed with patterns or designs. The embossed patterns or designs may match the coloured patterns or designs. In some embodiments, the bat may be adapted to incorporate or be coated with a substance that fluoresces under exposure to ultra violet light.

The bat may incorporate or be coated by a substance operable to change colour or fluoresce in response to impacts. This can enable the impact point of a ball to be determined.

The spine may incorporate a cutaway portion. The cutaway portion may enable the bat to be carried by engagement with the cutaway portion. Such a bat may be readily carried by being hung from an article of clothing, a suitable bag or a bicycle or similar using the cutaway portion of the spine. The cutaway portion may be formed during moulding of the bat or may be separately formed after moulding. The cutaway portion may comprise a bore through the spine. The bore may be substantially circular or substantially elliptical in cross-section.

The surface of the handle may be patterned or embossed to aid grip.

The bat may typically have an overall length of the order of around 850 mm for use by adults or an overall length of the order of around 780 mm for use by junior players. The hitting surface may typically have a length of the order of around 550 mm for the adult bat or a length of the order of around 480 mm for the junior bat. The width may be of the order of around 90 mm. The thickness of the bat from hitting surface to spine may be of the order of around 70 mm According to a third aspect of the present invention there is provided a target article suitable for use in place of a set of stumps in cricket or in a cricket derived game comprising: a weighted base and a panel, the panel formed from a flexible resilient material and the base comprising a slot into which the panel may be inserted and thereby retained in an upright position, the panel and slot being adapted such that when struck by an object the panel is free to vibrate.

This provides a readily transportable substitute for a set of stumps and if struck sufficiently hard generates an audible sound.

The panel may be adapted to vibrate at one or more selected frequencies or at one or more selected modes. This can enable the panel to generate a distinctive audible signature.

The panel may incorporate or be coated by a substance operable to change colour or fluoresce in response to impacts. This can enable the impact point of a ball to be determined.

The panel may also be provided with sensing means operable to detect the impact of a ball upon the panel. Such sensing means may be operable to generate an electrical output signal. The signal may be used by a connected scoring device to update the game score. The signal may also be used to trigger the operation of additional devices.

According to a fourth aspect of the present invention there is provided a cricket derived game for a plurality of players wherein at anyone time one player is in bat, one player is bowling and the remaining players are each occupying separate predefined fielding areas and wherein points are awarded to each player as follows: when batting, for hitting the ball into one or more particular predefined zones; when bowling, for hitting the batter's wicket, causing the batter to hit the ball into one or more predefined zones, or causing the batter to hit the ball wherein the ball is caught by a fielder; when fielding, for catching a batter hit by the batter; and wherein each player is exposed to an equal amount of balls bowled by each other player and wherein each player spends an equal amount of time batting, bowling and occupying each predefined fielding area.

This provides a cricket derived game that can be readily implemented in a limited space and allows each player to remain involved and compete with each other player throughout.

The players may remain in particular designated positions for a predetermined number of balls (an over) before moving to their next designated position. The predetermined number of balls may be any suitable number but would typically be say 4 or 6.

The game may be spilt into a plurality of different plays with each play comprising each player batting once and bowling once.

Scoring zones may be marked areas on walls surrounding the playing area.

According to a fifth aspect of the present invention there is provided a player rotation sequence for implementing the game of the fourth aspect of the present invention with n players wherein each player is assigned an ordinal number from 1 to n, and the game comprises n−1 numbered plays, each play comprising n numbered overs wherein: in each over of each play the player assigned the ordinal number matching the number of the over bats; in the first over of each play, the player assigned the ordinal number equal to the number of the play plus one bowls and in subsequent overs in each play the player assigned the next successive ordinal number bowls, one being considered to be the next successive ordinal number after n; each player not batting or bowling in the first over of each play is allocated to a particular fielding position and in successive overs each said fielding position is occupied by the player assigned the next successive ordinal number, one being considered to be the next successive ordinal number after n.

This thus provides a sequence that allows each player to be exposed to an equal amount of balls bowled by each other player and wherein each player spends an equal amount of time batting, bowling and occupying each predefined fielding area.

Preferably, the sequence is further arranged such that each fielder has fielded in each different field position for one over faced by each batter.

In a preferred example, the game is played by six players and thus comprises five plays of six overs. Such a game might be expected to have a playing time of say 50 minutes.

According to a sixth aspect of the present invention there is provided a playing area for the game of the fourth aspect of the present invention, the playing area comprising: a ground surface suitable for being marked with a batting crease, a bowling crease and a plurality of predefined fielding areas; and four substantially upright wall surfaces, each wall surface being either substantially parallel to the direction of bowling or substantially perpendicular to the direction of bowling, each wall surface suitable for being marked so as to be divided into a plurality of scoring areas.

This thus provides an area in which a game in accordance with the fourth aspect to the present invention may be played.

The walls and ground surface may be marked by use of tape, string, cord, paint, chalk, pen, pencil or similar. The value of each scoring area may be labelled using tape, string, cord, paint, chalk, pen, pencil or similar or by the use of a banner, sign or similar.

The upright wall surfaces may be provided by the existing walls of a room or gymnasium or similar. Additionally or alternatively the upright wall surfaces may be provided by a fence or similar around an area.

In alternative embodiments, markings on the ground surface may be provided by laying down a suitably marked panel, sheet, rug or similar.

In other embodiments, one or more dedicated wall surfaces may be provided temporarily, permanently or semi-permanently.

According to a seventh aspect of the present invention there is provided a dedicated wall surface, suitable for use in a playing area according to the sixth aspect of the present invention, the dedicated wall surface comprising: a substantially planar surface suitable for being marked so as to be divided into a plurality of scoring areas; and means for retaining the substantially planar surface in a substantially upright orientation.

Such dedicated wall surfaces can enable a playing area to be created on a temporary, permanent or semi-permanent basis.

Dedicated wall surfaces may be formed from any suitable material and are preferably at least partly transparent or translucent. In one embodiment, dedicated wall surfaces may be formed from wire mesh. In another embodiment, dedicated wall surfaces may be formed from substantially transparent or translucent polycarbonate panels.

Dedicated wall surfaces may be provided with permanent markings. Dedicated wall surfaces may also be provided with sensing means operable to detect the impact of a ball upon the planar surface. Such sensing means may be operable to generate an electrical output signal. The signal may be used by a connected scoring device to update the game score. The signal may also be used to trigger the operation of additional devices.

The planar surface may incorporate or be coated by a substance operable to change colour or fluoresce in response to impacts. This can enable the impact point of a ball to be determined.

In one embodiment, each wall surface is provided by a panel comprising a pair of substantially parallel planar surfaces with a space therebetween. In one preferred embodiment, the panel comprises a pair of polycarbonate sheets with a space therebetween. Preferably such a panel is provided with sensing means operable to detect the impact of a ball and output an electrical signal indicative thereof. Preferably, each wall surface is comprised of a plurality of such panels, each panel corresponding to a scoring zone. Each panel may be tinted in a particular colour and or marked with a particular score value. Means may be provided for feeding, smoke, steam, coloured gas or similar into the space between the pair of substantially parallel planar surfaces. Lighting means may be mounted on the panels or in the space between the pair of substantially parallel planar surfaces. The lighting means may be illuminated in response to ball impact. Audio output means may also be provided. The audio output means may be activated in response to ball impact.

Such a playing area may be set up in an arena allowing for large crowds to watch a game in progress. In such cases, video cameras and/or microphones may be mounted in the panels enabling capture of the action.

According to an eighth aspect of the present invention there is provided a kit for implementing the game of the fourth aspect of the present invention comprising: one or more bats, one or more balls, one or more sets of stumps, means for marking the fielding areas and the scoring zones; and a scoring device.

The or each ball may be a ball in accordance with the first aspect of the present invention. The or each bat may be a bat in accordance with the second aspect of the present invention. The or each set of stumps may be a target article in accordance with the third aspect of the present invention.

The means for marking may comprise tape, string, cord (including elasticised cords), paint, chalk, pen, pencil or similar. Additionally or alternatively, the means for marking may comprise one or more banners, signs, panels, sheets, rugs or similar. The kit may include means for attaching said banners, signs, panels, sheets, rugs or similar to a surface. The means for attaching may include any or all of clips, hooks, tape, string, cord (including elasticised cords), adhesive or similar.

The scoring device may be a score table or score board provided on paper, card, plastic or a wipe clean surface. Alternatively, a suitably adapted electronic scoring device may be provided. As a further alternative, the scoring device may comprise a board having a plurality of markers, each marker adapted to slide along a slot or rail, wherein a scoring scale is provided alongside the slot or rail.

The kit may further include a rules sheet or booklet and/or a playing sequence sheet or booklet. The kit may be provided in a dedicated bag. In an alternative, the rules and the playing sequence may be provided on one or more banners, signs, panels or similar.

The kit may further include one or more dedicated wall surfaces according to the seventh aspect of the present invention.

In order that the present invention is more clearly understood exemplary embodiments will be described further below, with reference to the accompanying drawings in which:

FIG. 1*a* shows a ball according to the first aspect of the present invention;

FIG. 1*b* shows a cross-section of the ball of FIG. 1*a;*

FIG. 2*a* is a front view of a bat according to the second aspect of the present invention;

FIG. 2*b* is a rear view of the bat of FIG. 2*a;*

FIG. 2*c* is a side view of the bat of FIGS. 2*a* and 2*b;*

FIG. 2*d* shows a cross-section of the bat of FIGS. 2*a*, 2*b* and 2*c;*

Figure 1A:
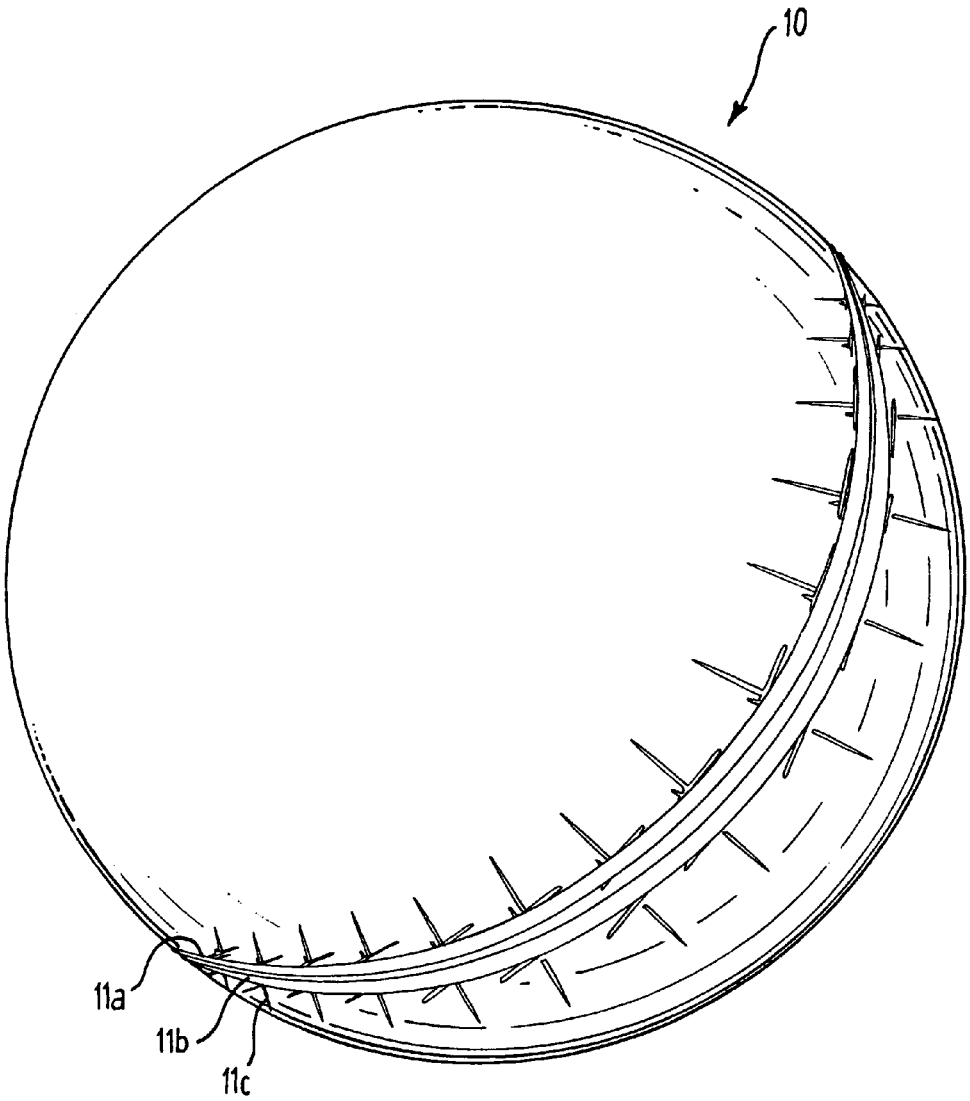
Figure 1B:
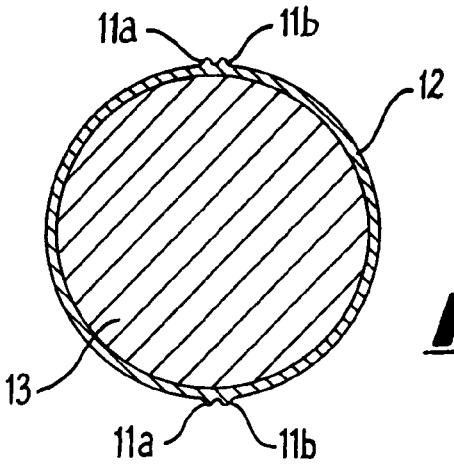
Figure 2D:
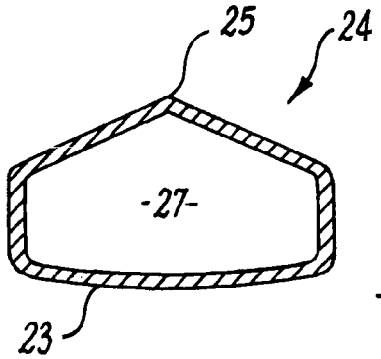

Referring now to FIGS. 1*a* and 1*b* a ball 10 adapted for use in cricket or a cricket derived game is shown. The ball 10 has a pair of raised circumferential bands 11*a*, 11*b* which form part of a decorative 'seam' 11. The bands 11*a*, 11*b*, simulate the seam of a conventional cricket ball and in the example shown are decorated to provide a barb wire type effect. The side projections 11*c* may also be raised or may be achieved by painting, printing or similar.

In construction, the ball comprises an injection moulded polyvinyl chloride (PVC) cover 12. The core of the ball 13 is typically low density polyurethane or polyurethane foam.

The PVC cover 12 enables the ball 10 to withstand abrasion damage caused by impact with hard or abrasive surfaces such as concrete or tarmac.

The core 13 provides additional structural support to the cover 12. This helps the ball to maintain its shape following repeated impacts and reduces the likelihood of cracks appearing in the cover 12. By being of low density, the core 13 adds relatively little mass to the ball 10 and thus impacts by the ball on passers by and/or property cause minimal damage.

By virtue of the above features, the ball 10 is ideally adapted to enable play of cricket or cricket derived games in areas with limited space, particularly inner city urban areas. The relative lightness of the ball 10 further enables it to be used safely by children. The ball 10 may also be coloured such that it can be used in poor light conditions.

Turing now to FIGS. 2*a*-2*d*, a bat 20 adapted for use in cricket or a cricket derived game is shown. The bat 20 substantially takes the shape of a conventional cricket bat having a handle 21 and a head 22, the head 22 provided with a hitting surface 23 and a back surface 24, the back surface having an axial spine 25. A non-conventional feature provided is bore 26 through spine 25. This provides a means by which the bat 20 may be hung or carried.

The bat 20 is formed from a suitable plastic or composite material by blow moulding. As such, the bat has a central cavity 27. This form of construction makes the bat 20 relatively light whilst still retaining sufficient strength for purpose. Additionally a plastic or composite bat 20 is relatively resistant to abrasion damage upon impact with abrasive surfaces such as concrete or tarmac.

By virtue of the above features, the bat 20 is ideally adapted to enable play of cricket or cricket derived games in areas with limited space, particularly inner city urban areas. The relative lightness of the bat 20 further enables its to be used safely by children.

Figure 3:
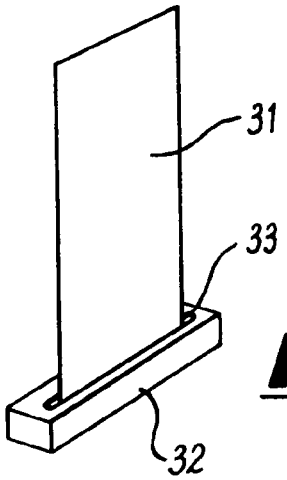
FIG. 3 shows a set of stumps according to the third aspect of the present invention.
Figure 2A:
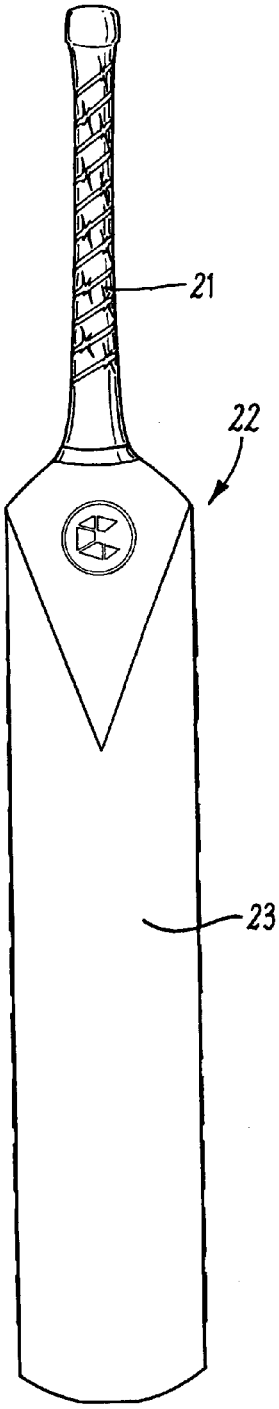
Figure 2B:
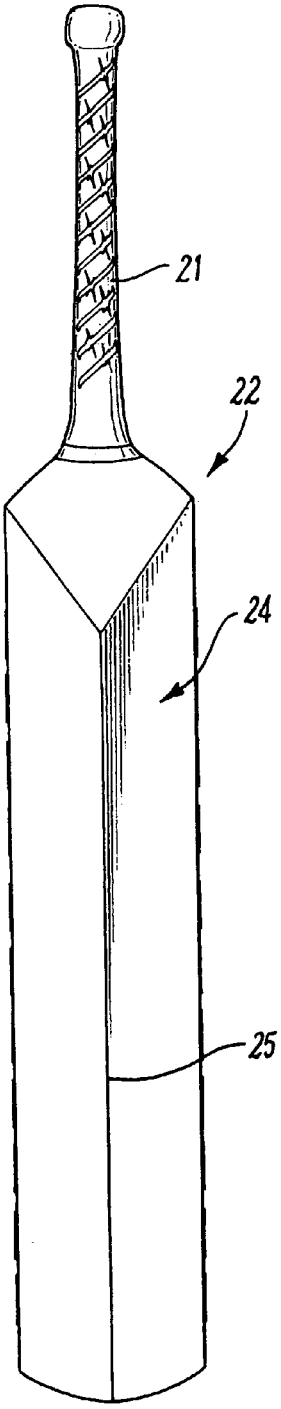
Figure 2C:
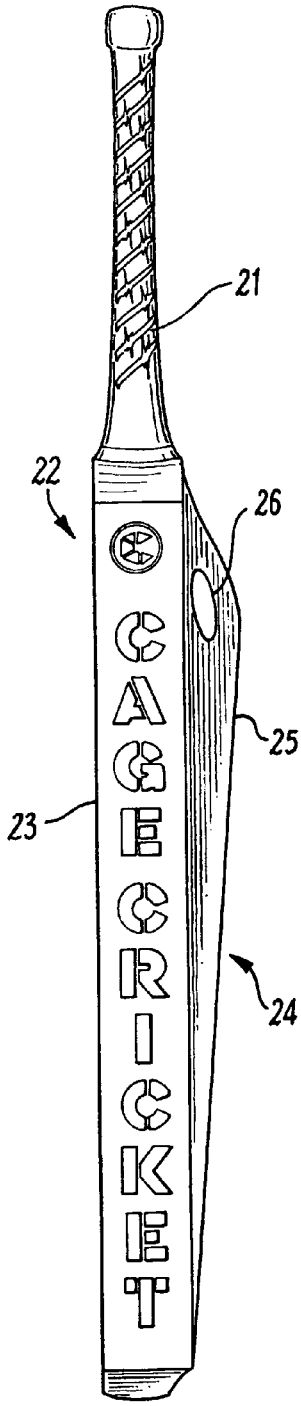

Turing now to FIG. 3 a substitute set of stumps 30 is shown. This comprises an upstanding panel 31 secured in a slot 33 of a weighted base 32. The sheet 31 is a flexible sheet and is free to vibrate such that when impacted, such as by a ball 10 or bat 20 an audible sound may be produced and/or the vibration may easily be observed by nearby players. Such a substitute set of stumps 30 may be relatively light weight, cheap and is thus readily transportable and useful for enabling play of cricket or cricket derived games in areas with limited space, particular inner city urban areas.

Figure 4:
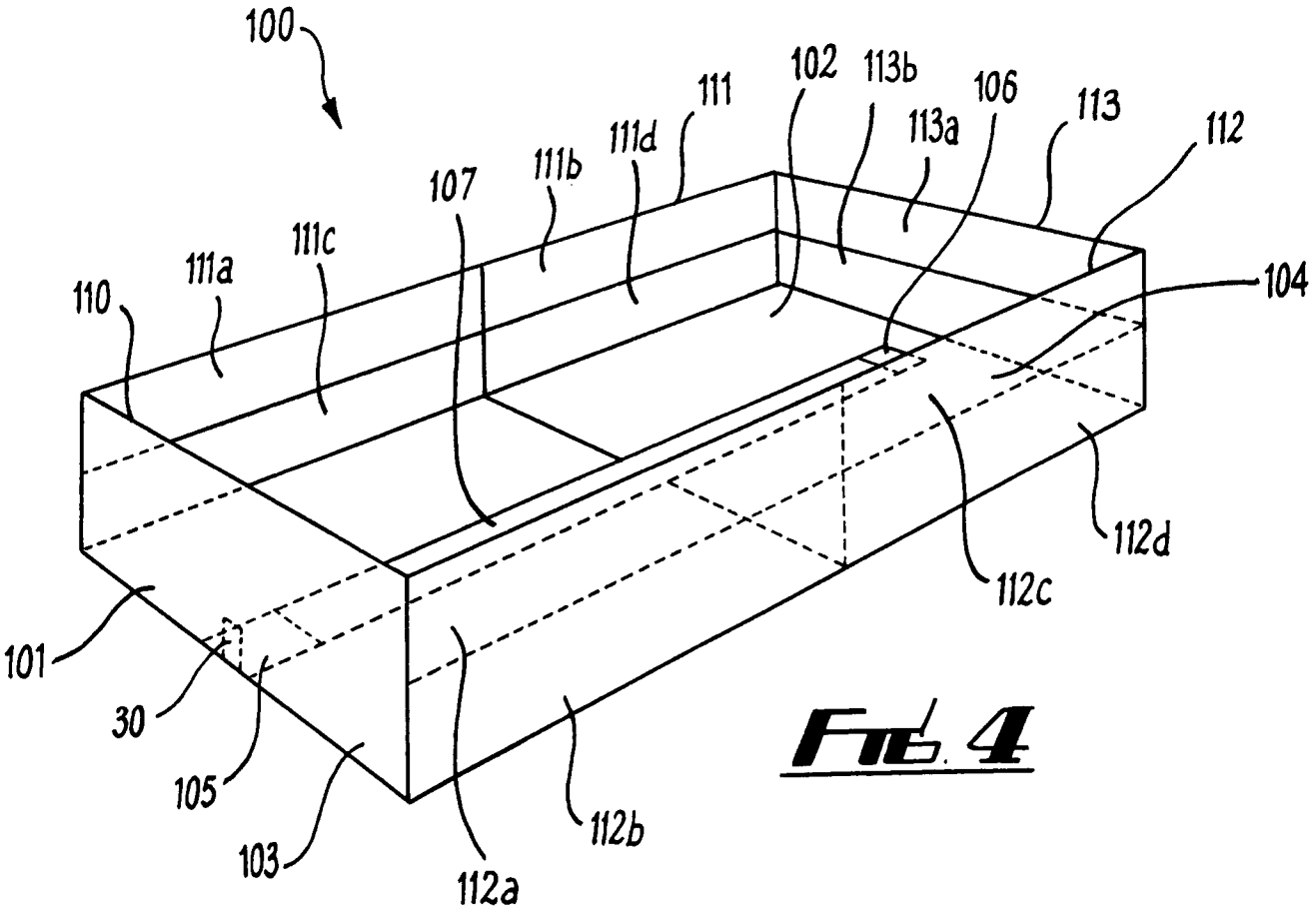
FIG. 4 shows a playing area for a cricket derived game according to the sixth aspect of the present invention.

In a further aspect, the invention provides for a particular cricket derived game suitable for play in limited space using the above ball 10, bat 20 and stumps 30 (or other equivalent equipment). The game is described with reference to the dedicated playing area shown in FIG. 4.

It should however be born in mind that the game could be played in any suitable space including hall or sports hall, a gymnasium, a tennis or basketball court, a multi-use games arena or similar wherein suitable markings are laid out. A kit comprising balls, bats, wicket and suitable markings may be provided for enabling the game to be played in such locations.

The playing area 100 comprises a ground surface divided into four fielding zones 101-104, a batting crease 105, a bowling crease 106 and a bowling pitch 107. A set of stumps 30 is provided behind the batting crease. The walls 110, 111, 112, 113 are divided into scoring zones. The side walls 111 and 112 are dived into quadrant scoring zones 111*a*, 111*b*, 111*c*, 111*d*, 112*a*, 112*b*, 112*c*, 112*d*, each zone being assigned a points value. The bowler's end wall 113 is divided in to upper and lower scoring zones 113*a*, 113*b*, each zone being assigned a points value. The batter's end wall 110 is not subdivided. An example of how points might be assigned to each scoring zone is set out in the table below:

| Scoring Zone | Points Value |
|---|---|
| 111a | 20 |
| 111b | 40 |
| 111c | 10 |
| 111d | 30 |
| 112a | 20 |
| 112b | 40 |
| 112c | 10 |
| 112d | 30 |
| 113a | 60 |
| 113b | 50 |

In play, a batter occupies the batting crease 105, a bowler occupies the bowling crease 106 and one field occupies each of the fielding areas 101-104. The bowler bowls a ball 10 at the batter along the pitch 107. The batter attempts to hit the ball 10 with a bat 20. The batter, bowler and fielders may be awarded points in respect of what subsequently transpires with the ball. If the batter manages to hit the ball 10 past the fielders such that it hits one of the side walls 111, 112 or end wall 113 they are awarded points equal to the value of the zone of the wall 111, 112, 113 that they hit. If the batter hits the ball 10 onto wall 110 they lose points and the bowler is awarded points. If the batter hits the ball and it is caught by the bowler or one of the fielders before hitting the ground, the bowler and the catcher (bowler or fielder) are awarded points. If the batter misses the ball 10, the bowler is awarded points, the number of points awarded being determined by whether the ball 10 subsequently hits the stumps 30 or end wall 110.

Typically, a bowler may bowl and over of say six balls at the batter with bowler batter and fielders remaining in their positions until the full over is bowled. In order to allow each player to participate fully, after each over the players change positions. In order that this position change is managed fairly and so that players have an equal opportunity to score points over the full course of a game, the game may be divided up in to (in the six player example) five separate plays each of six overs, wherein each player bats for one over, bowls for one over and fields for one over in each position in each play. The position changes after each over may be carried out in correspondence with a predetermined sequence such as that shown in FIG. 5 for six players wherein each player is assigned an ordinal number from 1 to 6.

Figure 5:
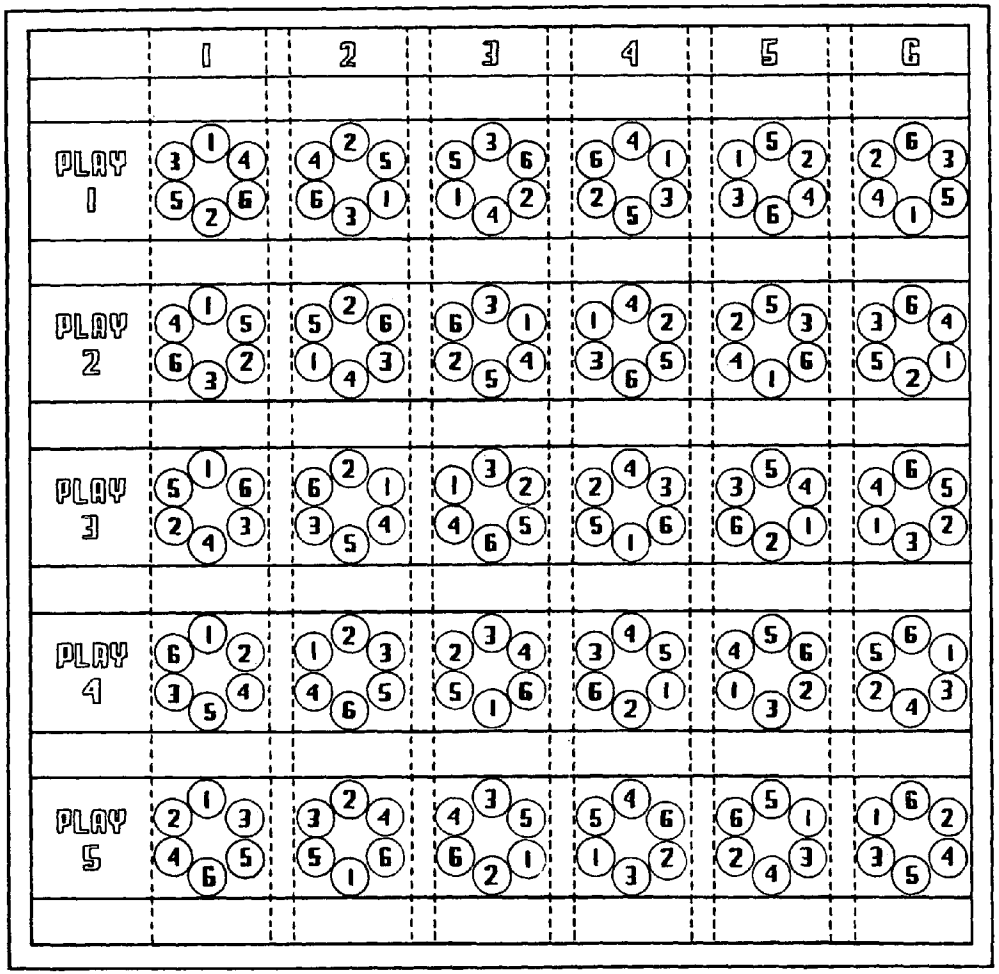
FIG. 5 illustrates a player rotation sequence according to the fifth aspect of the present invention.

In the sequence of FIG. 5, the grid represents five plays of six overs each. In the box representing each over the top position is the batter and the bottom position is the bowler, the remaining positions being the fielding positions. As can be seen, player one bats in the first over of each play, player two bats in the second over of each play and so forth to player six batting the sixth over of each play. With regard to bowling, player two bowls the first over of play one, player three bowls the first over of play three and so forth to player six bowling the first over of play five. Subsequent overs in each play are then bowled by the player with the next successive number with one being considered to be the next successive number after six. The non-bowling and non-batting players in the first over of each play are each allocated to a fielding position. In the subsequent overs in that play, each particular fielding position is then occupied by the player with the next successive number with one being considered to be the next successive number after six. The allocation of fielders in the first over of each play may further be adapted such that each fielder fields in each fielding position at least once to each batter.

Figure 6:
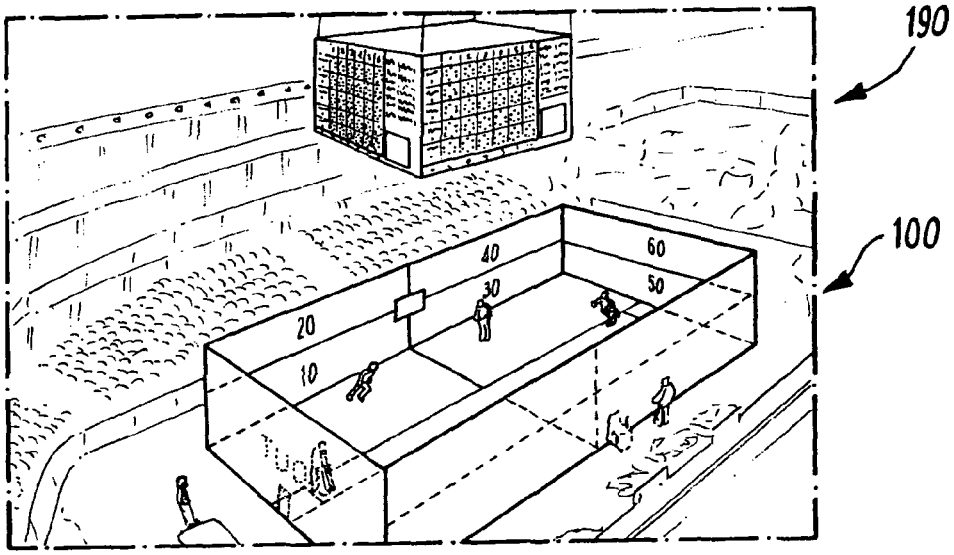
FIG. 6 shows one embodiment of a playing area in a sports arena.

In locations where no suitable walls are provided, temporary, permanent or semi-permanent walls may be provided. In particular, such walls may be at least partially or substantially transparent or translucent. This can enable a game in progress to be followed by spectators. In a particular implementation, a playing area 100 can be erected in a sports arena 190, thereby allowing large numbers of persons to follow a game, as is shown in FIG. 6.

Figure 7:
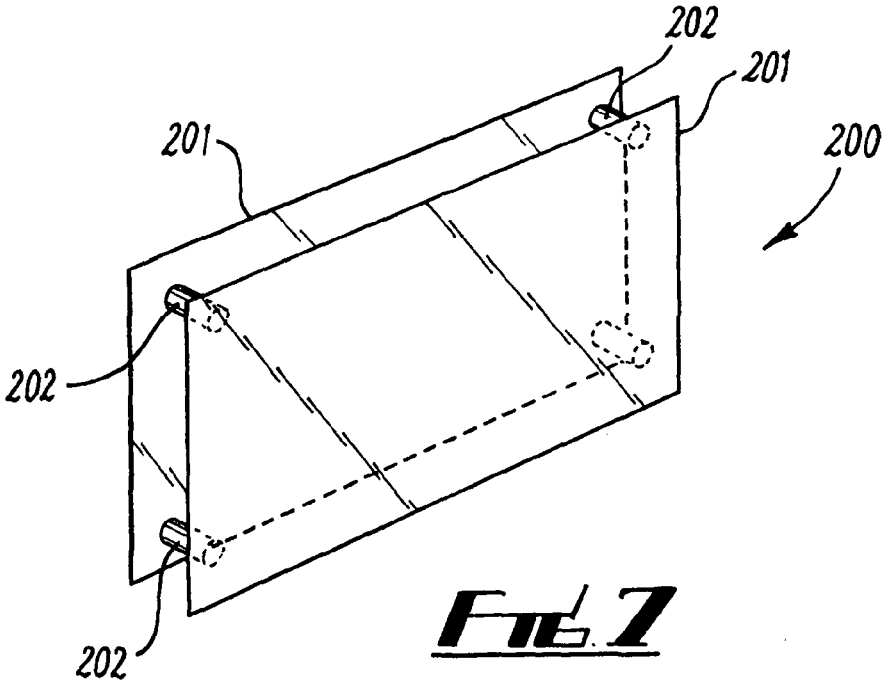
FIG. 7 shows one embodiment of a panel for constructing walls for the playing area.

In order to allow such an implementation, the walls may be formed from wire mesh or alternatively may be formed a plurality of panels 200 of the type shown in FIG. 7. The panels 200 comprise a pair or parallel sheets 201 of polycarbonate with a space therebetween. The sheets are connected together by spacer members 202 which can have mounted therein or thereon various devices.

In a preferred embodiment, each wall is made up of a plurality of separate panels 200. One or more panels 200 may make up each scoring zone, the panels being tinted or otherwise marked to identify the scoring zone. The panels 200 are provided with sensing means operable to detect the impact of a ball thereon and generate a resultant electrical output signal. The sensing means may be contact sensors, pressure sensors or piezoelectric sensors operable to detect impact related vibration. Outputs from the sensing means may be communicated to an electronic scoring system.

Additionally, outputs from the sensing means may be fed to other devices. Accordingly, an impact detected by the sensing means may activate lights or loudspeakers associated with the panel 200 (whether mounted on the panel or provided elsewhere). This can help to communicate information relating to the position of ball impact to spectators. A further possibility is that one or more fog machines (or outputs of fog machines) can be provided in the spacer members 202 allowing the release of theatrical fog into the space between the sheets at particular moments.

In an alternative implementation, the walls may be formed from wire meash provided over a suitable frame. Such frame and mesh walls may be provided with suitable sensors, lighting, audio or other devices in a similar manner to that described for panels 200. Where necessary, these devices may be mounted on or within suitable portions of the frame.

It is of course to be understood that the invention is not to be limited to the details of the above embodiments which are described by way of example only.

The invention claimed is:

1. A method of playing a cricket derived game by a plurality of players, comprising the steps of:

designating a playing area that includes a batting crease, a bowling crease, a bowling pitch and a plurality of predefined fielding zones;

further defining the playing area by equipping the playing area with two substantially upright opposing side walls arranged substantially parallel to said bowling pitch and two substantially upright opposing end walls arranged substantially perpendicular to said bowling pitch, one of said end walls being located behind said batters crease, the other of said end walls being located behind said bowlers crease, each of said side walls and said end walls being marked with a plurality of scoring zones;

equipping the players with a bat having a handle and a head, the head having a hitting surface;

equipping the players with a ball;

equipping the players with a target article, the target article being located behind the batting crease; and providing a set of rules including the requirements that at any one time a first of said plurality of players is a batter, a second of said plurality of players is a bowler and a remainder of said plurality of players are fielders each occupying a separate one of said plurality of predefined fielding zones and wherein points are awarded to each player as follows:

when the player is a batter, for hitting the ball into one or more of said predefined fielding zones;

when the player is a batter, for hitting the ball onto one of said scoring zones on one of said walls;

when the player is a bowler, for hitting the target article, causing the batter to hit the ball into one or more of said plurality of predefined fielding zones, or causing the batter to hit the ball wherein the ball is caught by a fielder;

when the player is a fielder, for catching a ball hit by the batter;

wherein each of said plurality of players is exposed to an equal amount of balls bowled and wherein each of said plurality of players spends an equal amount of time batting, bowling and occupying each of said plurality of predefined fielding zones;

actively playing the cricket-derived game on the defined playing area within the walls, wherein the plurality of players comprises n players, and the rules establish a rotation sequence for the players, the rules including the requirements that each of said plurality of players is assigned an ordinal number from 1 to n, and the game comprises n−1 numbered plays, each play comprising n numbered overs wherein:

in each over of each play, the player assigned the ordinal number matching the number of the over is the player who bats;

in the first over of each play, the player assigned the ordinal number equal to the number of the play plus one bowls and in subsequent overs in each play the player assigned the next successive ordinal number bowls, one being considered to be the next successive ordinal number after n; and each player not batting or bowling in the first over of each play is allocated to a particular fielding position and in successive overs each said fielding position is occupied by the player assigned the next successive ordinal number, one being considered to be the next successive ordinal number after n.

2. The method of claim 1 wherein the target article comprises a weighted base and a flexible panel, the base comprising a slot into which the flexible panel is inserted and thereby retained in an upright position, the panel and slot being adapted such that when struck by said ball the panel is free to vibrate.

3. The method of claim 1, wherein n is 6;

the game consists essentially of 5 plays, each play consisting essentially of 6 overs; and each over consists essentially of the bowler bowling the ball towards the batter 6 times.

4. The method of claim 1, wherein each of said side walls is divided into quadrants, each of said quadrants defining one of said scoring zones on said side wall.

5. The method of claim 1, wherein said plurality of scoring zones on said end wall behind said bowlers crease is divided into an upper portion and a lower portion, said upper portion defining a first scoring zone of said end wall behind said bowlers crease, and said lower portion defining a second scoring zone of said end wall behind said bowlers crease.

* * * * *